US007520778B1

(12) United States Patent
Chong

(10) Patent No.: US 7,520,778 B1
(45) Date of Patent: Apr. 21, 2009

(54) PRESSURE RING IN PLASTIC CLAMPING PLATE TO OVERCOME COMPRESSION STRESS RELAXATION (CSR) BETWEEN ELASTOMER GASKET AND PLASTIC PLATE TO SEAL A DIN 7/16 CONNECTOR

(75) Inventor: Yin-Shing Chong, Middletown, CT (US)

(73) Assignee: ALCATEL LUCENT, Paris (FR)

( * ) Notice: Subject to any disclaimer, the term of this patent is extended or adjusted under 35 U.S.C. 154(b) by 0 days.

(21) Appl. No.: 12/007,304

(22) Filed: Jan. 9, 2008

(51) Int. Cl.
*H01R 13/73* (2006.01)

(52) U.S. Cl. ..... 439/559; 439/556

(58) Field of Classification Search ..... 439/559, 439/556

See application file for complete search history.

(56) References Cited

U.S. PATENT DOCUMENTS 5,511,990 A * 4/1996 Klemen ..... 439/559
6,113,424 A * 9/2000 Shinozaki ..... 439/559

* cited by examiner

*Primary Examiner*—Truc T Nguyen
*Assistant Examiner*—Xuong M Chung-Trans

(57) ABSTRACT

A cylindrical body assembly, such as a DIN connector, also including one or more of the following: a substrate with an opening, the DIN connector extending into the opening; a gasket mating with the DIN connector; a clamping plate mating with the substrate and the gasket; and a pressure ring integral with said clamping plate, extending into the opening in the substrate, the pressure ring mating with the gasket.

16 Claims, 5 Drawing Sheets

PRESSURE RING IN PLASTIC CLAMPING PLATE TO OVERCOME COMPRESSION STRESS RELAXATION (CSR) BETWEEN ELASTOMER GASKET AND PLASTIC PLATE TO SEAL A DIN 7/16 CONNECTOR

BACKGROUND OF THE INVENTION

1. Field of the Invention

This invention relates generally to seals for DIN 7/16 connectors.

2. Description of Related Art

The name 7/16 DIN connector (or DIN 7/16 connector) comes from the size of the inner and outer contacts of the connector, in metric measurements. In particular, the inner contact on the 7/16 DIN connector measures 7 mm while the outer contact on the connector measures 16 mm. Designed for communications systems, the 7/16 DIN connector functions with communications equipment having as much as 100 watts of power per channel.

DIN 7/16 connectors are used in a variety of applications around the world. Some of these applications include antennas, base stations, satellite communications, and other high power communications applications.

A variety of benefits are available from 7/16 DIN connectors over other audio and communications standards. For example, 7/16 DIN connectors are low Voltage Standing Wave Ratio (VSWR) for excellent audio performance. DIN 7/16 connectors are easy to install with or without the use of tools and wrenches. The design of DIN 7/16 connectors prevents dust or other debris from interfering with the contacts. DIN 7/16 connectors also come in a variety of different materials, including silver plated contacts, which provide for a large amount of conductivity, improved performance, and corrosion resistance.

DIN connectors were originally standardized by the Deutsches Institut fur Normung, also known as the German national standards organization. These connectors and cables come in a variety of shapes and sizes, but all were originally standardized by the same group. The acronym DIN used to describe these connectors finds its origin in the name of this group.

The connectors standardized as DIN are most commonly found in audio and video devices. DIN connectors are now a usage standard throughout the world. There is a DIN connector in a large variety of audio and video devices manufactured using either analog or digital signals.

In order for DIN connectors to operate well in an outdoor environment, it is beneficial for the DIN connector to have a seal. Thus, there is a need for a seal to protect DIN connectors. However, seals that protect DIN connectors typically suffer from stress relaxation. Eventually, the effects of stress relaxation will cause the quality of a seal in a DIN connector to suffer.

Stress relaxation is a phrase used to describe how polymers and elastomers relieve stress under constant strain. Because they are viscoelastic, polymers and elastomers behave in a nonlinear, non-Hookean fashion. This nonlinearity is described by both stress relaxation and a phenomenon known as creep, which describes how polymers and elastomers strain under constant stress.

Viscoelastic materials have the properties of both viscous and elastic materials and can be modeled by combining elements that represent these characteristics. One viscoelastic model, called the Maxwell model predicts behavior akin to an elastic element such as a spring in series with a viscous element such as a dashpot. Another model, the Voigt model, places the elastic and viscous elements in parallel. Although the Maxwell model is good at predicting stress relaxation, it is fairly poor at predicting creep. On the other hand, the Voigt model is good at predicting creep but rather poor at predicting stress relaxation. The most accurate of the viscoelastic models is the Standard Linear Solid (SLS) model. The SLS model combines the characteristics of both the Maxwell and Voigt models to display both creep and stress relaxation. All of these models demonstrate a need to reduce the effects of stress relaxation and creep in seals for DIN connectors.

The foregoing objects and advantages of the invention are illustrative of those that can be achieved by the various exemplary embodiments and are not intended to be exhaustive or limiting of the possible advantages which can be realized. Thus, these and other objects and advantages of the various exemplary embodiments will be apparent from the description herein or can be learned from practicing the various exemplary embodiments, both as embodied herein or as modified in view of any variation which may be apparent to those skilled in the art. Accordingly, the present invention resides in the novel methods, arrangements, combinations and improvements herein shown and described in various exemplary embodiments.

SUMMARY OF THE INVENTION

In order to improve the operation of a DIN connector in an outdoor environment, a seal is needed around a hole in which the DIN connector is inserted. In various exemplary embodiments, the seal for a DIN connector functions over a long period of time without a need to replace the seal. Similarly, in various exemplary embodiments, the seal for a DIN connector functions effectively over a wide temperature range.

Various exemplary embodiments employ a flat gasket as a seal for a DIN connector. In embodiments employing a flat gasket, a clamping force is exerted on the flat gasket by a clamping plate. This clamping force typically is reduced over time due to stress relaxation in a plastic cover that exerts the clamping force, and also in a polymer or elastomer gasket that receives the clamping force.

The foregoing reduction in the clamping force over time due to stress relaxation often results in a failure of the seal for the DIN connector when a flat gasket is used. This failure of the seal in the DIN connector often occurs before a sufficiently long period of time has passed resulting in water damage to the equipment that the connector is attached to. Accordingly, various exemplary embodiments provide a seal in a DIN connector that functions over a longer period of time than the seal available from embodiments employing a flat gasket.

In light of the present need for a pressure ring in plastic clamping plate to overcome compression stress relaxation (CSR) between a polymer or elastomer gasket and a plastic plate to seal a DIN 7/16 connector, a brief summary of various exemplary embodiments is presented. Some simplifications and omission may be made in the following summary, which is intended to highlight and introduce some aspects of the various exemplary embodiments, but not to limit its scope. Detailed descriptions of a preferred exemplary embodiment adequate to allow those of ordinary skill in the art to make and use the invention concepts will follow in later sections.

The subject matter described herein is described in connection with the particular example of DIN connectors. In connection therewith, reference is often made to 7/16 DIN connectors. However, it should be understood that, in various exemplary embodiments, the subject matter described herein applies to a DIN connector having dimensions other than 7/16. Likewise, it should be apparent that, in various exemplary embodiments, the subject matter described herein is adapted to any flange connector with a gasket used for waterproofing or any cylindrical body having a flat rectangular part on one end that is larger than the cylindrical body.

At times, reference is made herein to dimensions of a deformable body such as thickness. It should be understood that such references denote the dimensions of the deformable body at equilibrium, prior to deformation.

Accordingly, various exemplary embodiments are a cylindrical body assembly, such as a DIN connector assembly, including one or more of the following: a substrate having a substantially planar surface and an opening extending into the substrate; a DIN connector extending into the opening into the substrate, the DIN connector having a cylindrical outer surface; a gasket having an inner portion, a lower portion, and an outer portion, the inner portion of the gasket having an inner surface, an outer surface, and a bottom surface, the inner surface of the inner portion of the gasket mating with the outer surface of the DIN connector, the bottom surface of the inner portion of the gasket being substantially parallel to the substantially planar surface of the substrate, the lower portion of the gasket having an upper surface, the outer portion of said gasket having an inner surface and an upper surface; a clamping plate having a lower surface and an outer surface, the lower surface of the clamping plate being substantially planar and mating with the substantially planar upper surface of the substrate, the outer surface of said clamping plate mating with said outer surface of the inner portion of the gasket; and a pressure ring having an inner surface, an outer surface, and a lower surface, the inner and outer surfaces of the pressure ring extending away from the clamping plate into the opening in the substrate, the inner surface of the pressure ring mating with the outer surface of the inner portion of the gasket, the outer surface of the pressure ring mating with the inner surface of the outer portion of the gasket, and the lower surface of the pressure ring mating with the upper surface of the lower portion of the gasket.

In various exemplary embodiments one or more of the following are true: the DIN connector is a 7/16 DIN connector; a water tight seal is formed between the gasket and the DIN connector; the pressure ring is integral to the clamping plate; the pressure ring and the clamping plate are formed as a single continuous construction; a water tight seal is maintained between the gasket and the DIN connector, and also between the gasket and the clamping plate after stress relaxation has affected the gasket and the clamping plate and in a temperature range from −40° C. to 65° C.; the clamping plate is fabricated from a plastic; the gasket is fabricated from an elastomer; pressure exterted by the pressure ring forms the inner portion of the gasket, the lower portion of the gasket and the outer portion of the gasket as a ring-shaped recess that receives the pressure ring; the pressure ring extends around a perimeter of the opening in the substrate; the inter portion of the gasket has an equilibrium thickness and the inner portion of the gasket is compressed no more than 30% of its equilibrium thickness; and the lower portion of the gasket has an equilibrium thickness and lower portion of the gasket is compressed more than 30% of its equilibrium thickness.

In various exemplary embodiments, a length of the inter surface of the pressure ring, a length of the lower surface of the pressure ring, and a length of the outer surface of the pressure ring are all smaller than lengths of the cylindrical outer surface of the DIN connector, the substantively planar surface of the substrate, the inner surface of the inner portion of the gasket, and the outer surface of the inner portion of the gasket.

In various exemplary embodiments, the assembly includes a flat rectangular part on one end, the flat rectangular part having a thickness larger than a diameter of the cylindrical body.

BRIEF DESCRIPTION OF THE DRAWINGS

In order to better understand various exemplary embodiments, reference is made to the accompanying drawings, wherein.

DETAILED DESCRIPTION OF THE PREFERRED EMBODIMENTS OF THE INVENTION

Figure 1:
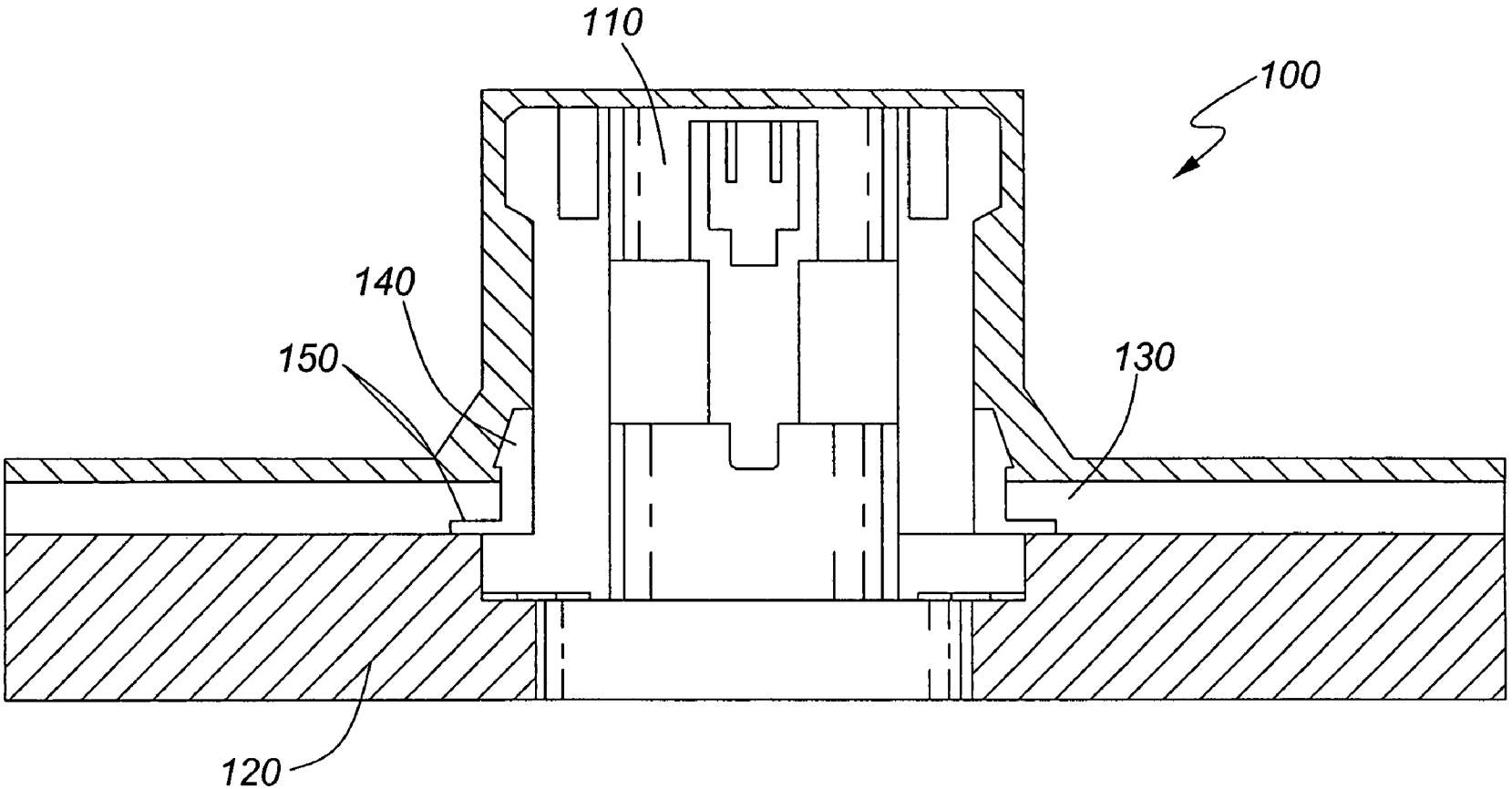
FIG. 1 is a cross-sectional view of a first exemplary embodiment of a DIN connector assembly.

Referring now to the drawings, in which like numerals refer to like components or steps, there are disclosed broad aspects of various exemplary embodiments.

FIG. 1 is a cross-sectional view of a first exemplary embodiment of a DIN connector assembly 100. The DIN connector assembly 100 includes a DIN connector 110, a substrate 120, a clamping plate 130, and a gasket 140. The gasket 140 includes a gland 150.

The gland 150 of the gasket 140 fits in a notch of the clamping plate 130. The confinement of the gland 150 of the gasket 140 underneath the notch of the clamping plate 130 aids in preventing relaxation or ridges on the gasket 140. Accordingly, the structure of the gland 150, and notch of the clamping plate 130 designed to receive the gland 150, helps prevent the effects of relaxation on the gasket 140.

It is believed that exemplary DIN connector assembly 100 is well suited to applications involving steel or a similarly strong or stronger material that has higher deflection temperatures. However, exemplary DIN connector assembly 100 may be less desirable for applications that include a space constraint because such space constraints make it difficult to seal a standard 7/16 DIN connector.

As typifies many industries, design specifications for DIN connectors seek to obtain a smaller connector as time passes. Accordingly, it is not uncommon for design engineers to be unable to find even an additional quarter inch of space for various design features of a DIN connector assembly. Put differently, the space available for design features in DIN connectors is getting tighter and tighter. Such space is at a premium.

One application contributing to the design constraints described above is an application where the DIN connector is mounted on a communications tower. In order to reduce stress on the tower from the weight of the product, and in order to minimize the load created by wind, the weight and size of a DIN connector in such installations is particularly important. Accordingly, exemplary DIN connector assembly 100 may not be suitable for various applications.

Figure 2:
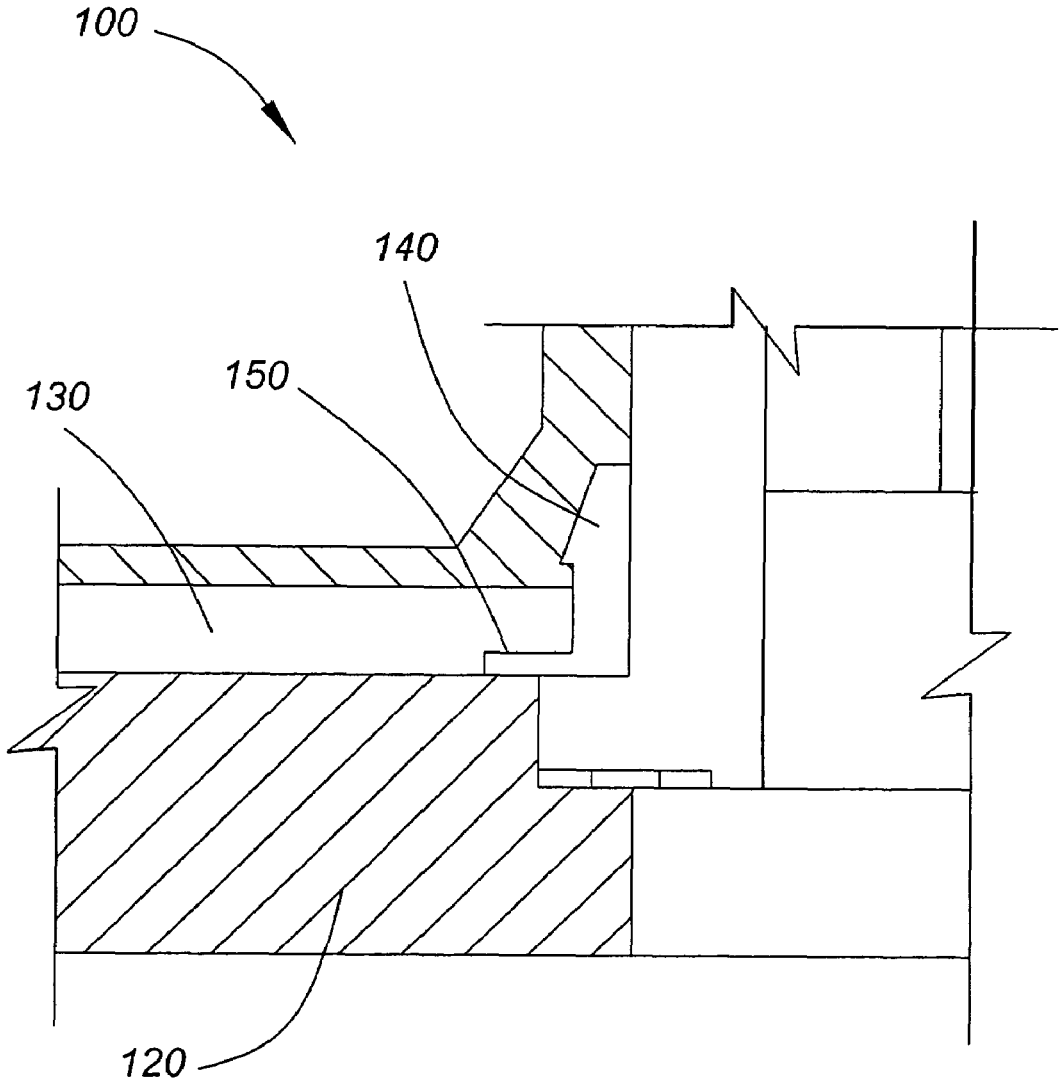
FIG. 2 is an enlarged, fragmented, cross-sectional view of the first exemplary embodiment of a DIN connector assembly.

FIG. 2 is an enlarged, fragmented, cross-sectional view of the first exemplary embodiment of the DIN connector assembly 100. The substrate 120, clamping plate 130 and gasket 140, including the gland 150, are shown enlarged in FIG. 2. A detailed discussion of the substrate 120, clamping plate 130 and gasket 140, including the gland 150, is provided above in connection with FIG. 1. The enlarged detail regarding the various elements of exemplary DIN connector assembly 100 are shown enlarged in FIG. 2 for additional reference in greater detail.

Figure 3:
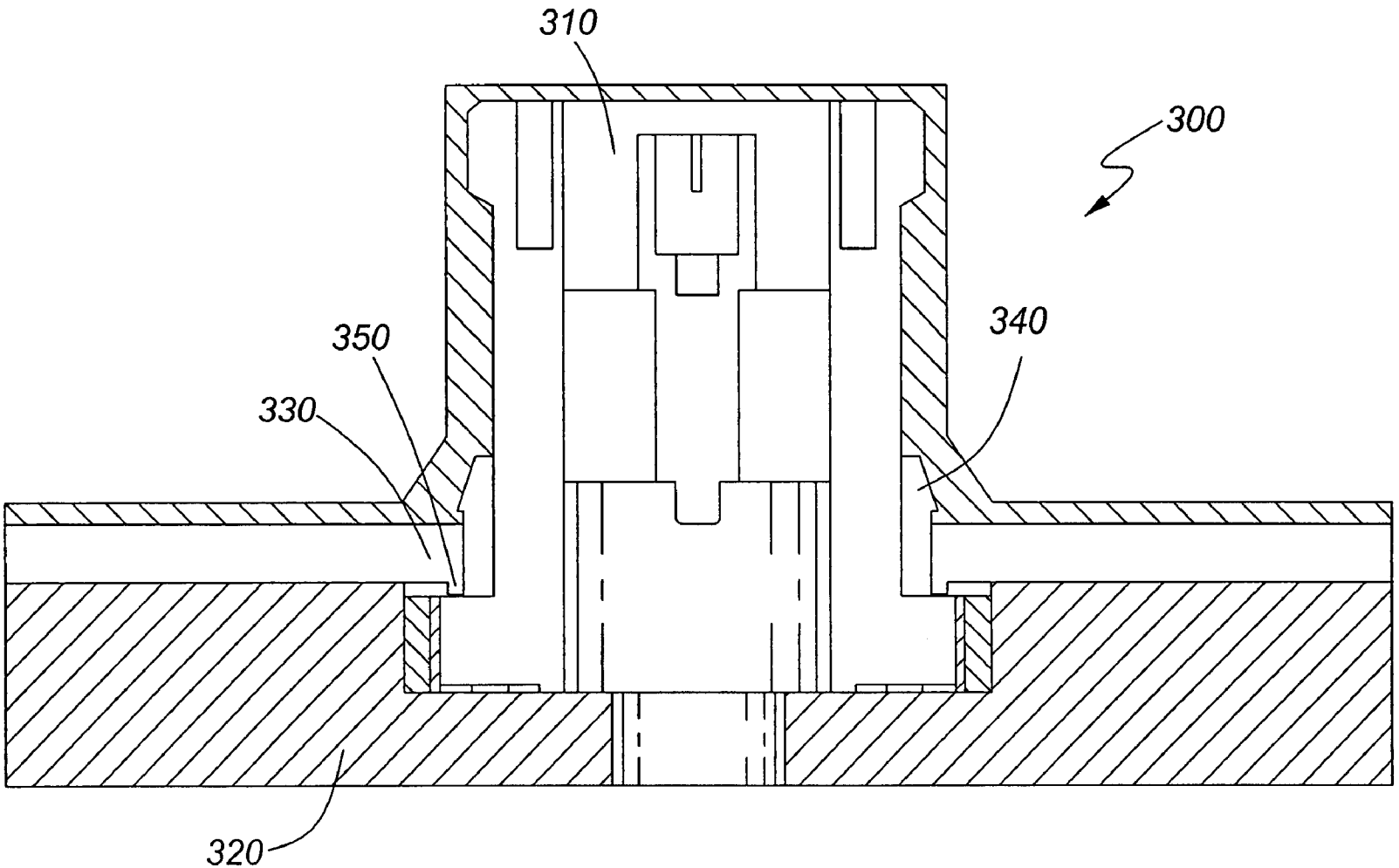
FIG. 3 is a cross-sectional view of a second exemplary embodiment of a DIN connector assembly.

FIG. 3 is a cross-sectional view of a second exemplary embodiment of a DIN connector assembly 300. The DIN connector assembly 300 includes a DIN connector 310, a substrate 320, a clamping plate 330, and a gasket 340. The clamping plate 330 includes a pressure ring 350.

In various exemplary embodiments, the clamping plate 330 is fabricated from a plastic. In various exemplary embodiments, the gasket 340 is fabricated from an elastomer.

The DIN connector 310 is essentially the same as the DIN connector 110 discussed above. Similarly, the substrate 320 is essentially the same as the substrate 120 discussed above. The substrate 320 will also be discussed in greater detail below.

Pressure exerted by the ring 350 forms a ring shaped recess in the gasket 340 into which the ring 350 is inserted. This structure helps ensure that the pressure exerted onto the gasket 340 around the 7/16 DIN connector 310 is maintained by the clamping plate 330 even when the clamping plate 330 is subjected to extreme temperatures. For example, in various exemplary embodiments, a proper seal is maintained between the clamping plate 330 and the gasket 340 in the temperature range of −40° C. to 65° C.

In various exemplary embodiments, the pressure ring 350 is an integral part of the clamping plate 330, fabricated as a single continuous construction. As depicted in connection with exemplary DIN connector assembly 300, the pressure ring 350 is located around the perimeter of the entrance to a hole.

In various exemplary embodiments, certain considerations are involved in the design of the dimensions of the pressure ring 350. For example, in various exemplary embodiments, it is believed to be desirable to compress about 30% of the thickness of the gasket 340, but not more than 30% of the thickness of the gasket 340. However, in various exemplary embodiments, the physical design of the pressure ring 350 enables the pressure ring 350 to provide a localized squeeze on the gasket 340 before the remainder of the gasket 340 is squeezed by the rest of the substrate 320. This forms a ring shaped recess in the gasket 340. In various exemplary embodiments, as depicted in FIG. 3, the ring-shaped recess has an inner surface, an outer surface and a lower surface.

In various exemplary embodiments, the pressure ring 350 is smaller with respect to other dimensions of the clamping plate 330. In various exemplary embodiments, the pressure ring 350 is raised above a planar surface of the clamping plate 330.

In various exemplary embodiments, the physical structure of the pressure ring 350 enables the pressure ring 350 to come in contact with the gasket 340 before the substrate 320 comes in contact with the gasket 340. Accordingly, in various exemplary embodiments, the pressure ring 350 squeezes the gasket 340 before the rest of the gasket 340 is squeezed by the substrate 320.

In various exemplary embodiments, the relative dimensions of the pressure ring 350 are designed such that the pressure ring 350 is relatively small with respect to the thickness of the substrate 320, clamping plate 330 and gasket 340. In various exemplary embodiments, the relatively small size of the pressure ring 350 with respect to the thickness of the substrate 320, clamping plate 330 and gasket 340 results in a relatively high localized pressure in the vicinity of the pressure ring 350.

In various exemplary embodiments, a relatively high localized pressure in the vicinity of the pressure ring 350 causes the pressure ring 350 to sink deeper into the gasket 340 and the remainder of the clamping plate 330. In various exemplary embodiments, the pressure ring 350 sinks into the gasket 340 a full amount of a height of the pressure ring 350, the height of the pressure ring 350 being an amount the pressure ring 350 protrudes with respect to the planar surface of the clamping plate 330.

In various exemplary embodiments, the gasket 340 is compressed to 30% of a thickness of the gasket 340 except in the vicinity of the pressure ring 350. In various exemplary embodiments, the pressure ring 350 sinks into the gasket 340 in a manner such that the gasket 340 is compressed greater than 30% of its thickness in the vicinity of the pressure ring 350.

In a typical application, the material from which the gasket 340 is constructed will relax over time. However, in various exemplary embodiments, the pressure ring 350 remains sunk into the gasket 340 even after relaxation of the material from which the gasket 340 is constructed. Accordingly, in various exemplary embodiments, a seal is maintained in the DIN connector assembly 300 even after stress relaxation of the gasket 340 has occurred.

Figure 4:
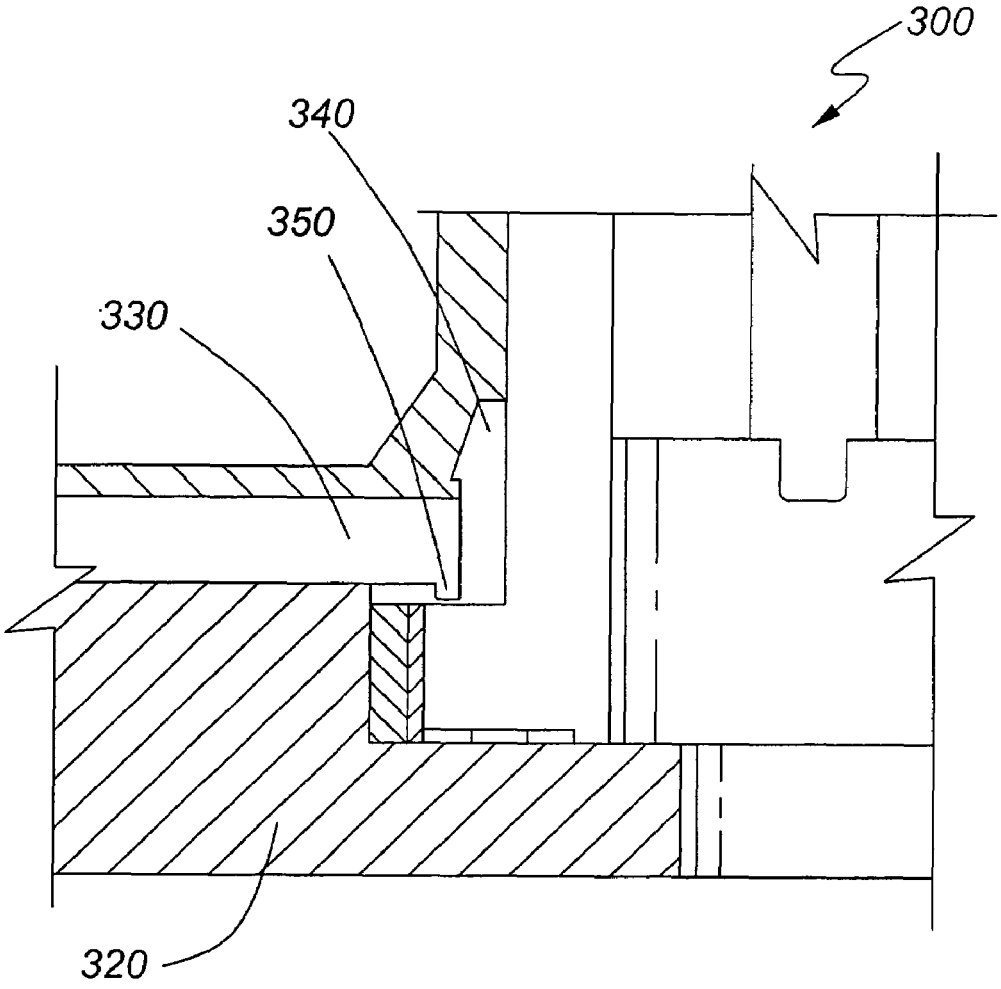
FIG. 4 is an enlarged, fragmented, cross-sectional view of the second exemplary embodiment of a DIN connector assembly.

FIG. 4 is an enlarged, fragmented, cross-sectional view of the second exemplary embodiment of the DIN connector assembly 300. The substrate 320, clamping plate 330, including the pressure ring 350, and the gasket 340, are shown enlarged in FIG. 4. The substrate 320, clamping plate 330, including the pressure ring 350, and the gasket 340, are described in greater detail above in connection with FIG. 3. These features are shown enlarged in FIG. 4 in greater detail for reference.

Based on the foregoing, various exemplary embodiments, achieve a high localized pressure in a vicinity of the pressure sealing ring 350. In various exemplary embodiments, localized pressure in the pressure sealing ring 350 is achieved even with a reduced clamping force. In various exemplary embodiments, the source of a reduced clamping force exists due to compression stress relaxation in the gasket 340 and/or the clamping plate 330.

Figure 5:
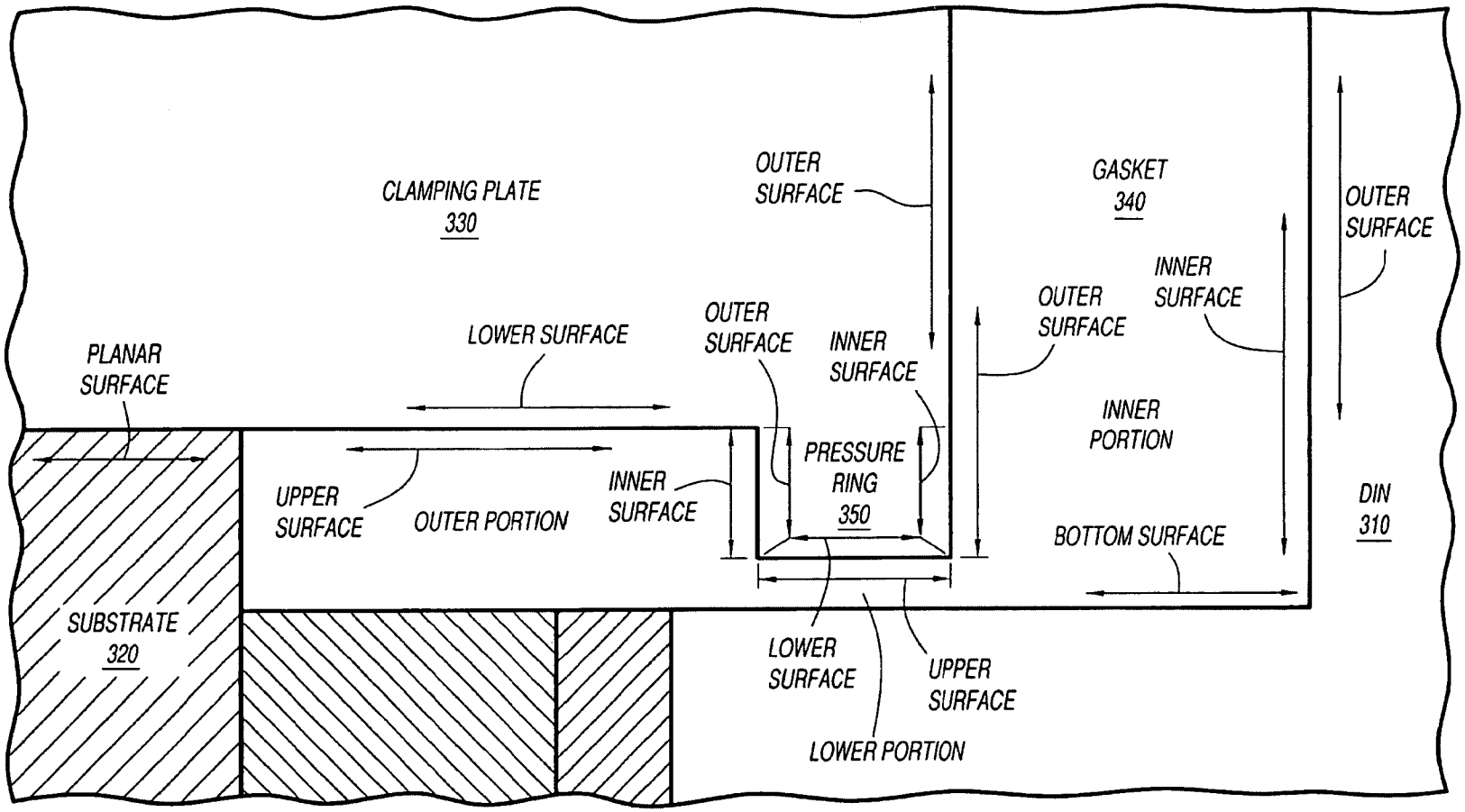
FIG. 5 is an enlargement of FIG. 4 illustrating how the pressure ring engages the gasket.

FIG. 5 is an enlargement of FIG. 4 illustrating how the pressure ring 350 engages the gasket 340. A cylindrical body assembly 310, such as a DIN connector, includes a substrate 320 having a substantially planar surface, the DIN connector 310 extending into an opening in the substrate 320, the DIN connector 310 having a cylindrical outer surface; a gasket 340 having an inner portion, a lower portion, and an outer portion, the inner portion of the gasket 340 having an inner surface, an outer surface, and a bottom surface, the inner surface of the inner portion of the gasket 340 mating with the outer surface of the DIN connector 310, the bottom surface of the inner portion of the gasket 340 being substantially parallel to the substantially planar surface of the substrate 320, the lower portion of the gasket 340 having an upper surface, the outer portion of said gasket 340 having an inner surface and an upper surface; a clamping plate 330 having a lower surface and an outer surface, the lower surface of the clamping plate 330 being substantially planar and mating with the substantially planar upper surface of the substrate 320, the outer surface of said clamping plate 330 mating with said outer surface of the inner portion of the gasket 340; and a pressure ring 350 having an inner surface, an outer surface, and a lower surface, the inner and outer surfaces of the pressure ring 350 extending away from the clamping plate 330 into the opening in the substrate 320, the inner surface of the pressure ring 350 mating with the outer surface of the inner portion of the gasket 340, the outer surface of the pressure ring 350 mating with the inner surface of the outer portion of the gasket 340, and the lower surface of the pressure ring 350 mating with the upper surface of the lower portion of the gasket 340.

Although the various exemplary embodiments have been described in detail with particular reference to certain exemplary aspects thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed is:

1. A DIN connector assembly, comprising:

a substrate having a substantially planar surface and an opening extending into said substrate;

a DIN connector extending into said opening into said substrate, said DIN connector having a cylindrical outer surface;

a gasket having an inner portion, a lower portion, and an outer portion, the inner portion of the gasket having an inner surface, an outer surface, and a bottom surface, the inner surface of the inner portion of the gasket mating with the outer surface of the DIN connector, the bottom surface of the inner portion of the gasket being substantially parallel to said substantially planar surface of said substrate, the lower portion of the gasket having an upper surface, the outer portion of said gasket having an inner surface and an upper surface;

a clamping plate having a lower surface and an outer surface, the lower surface of the clamping plate being substantially planar and mating with said substantially planar surface of said substrate and said upper surface of said outer portion of said gasket, the outer surface of said clamping plate mating with said outer surface of said inner portion of said gasket; and a pressure ring having an inner surface, an outer surface, and a lower surface, the inner and outer surfaces of the pressure ring extending away from said clamping plate into said opening in said substrate, the inner surface of the pressure ring mating with the outer surface of the inner portion of the gasket, the outer surface of the pressure ring mating with the inner surface of the outer portion of the gasket, and the lower surface of the pressure ring mating with the upper surface of the lower portion of the gasket.

2. The DIN connector assembly, according to claim 1, wherein the DIN connector is a 7/16 DIN connector.

3. The DIN connector assembly, according to claim 1, wherein a water tight seal is formed between the gasket and the DIN connector.

4. The DIN connector assembly, according to claim 1, wherein the pressure ring is integral to the clamping plate.

5. The DIN connector assembly, according to claim 4, wherein the pressure ring and the clamping plate are formed as a single continuous construction.

6. The DIN connector assembly, according to claim 1, wherein a water tight seal is maintained between the gasket and the DIN connector, and also between the gasket and the clamping plate after stress relaxation has affected the gasket and the clamping plate.

7. The DIN connector assembly, according to claim 1, wherein a water tight seal is maintained between the gasket and the DIN connector, and also between the gasket and the clamping plate, in a temperature range from −40° C. to 65° C.

8. The DIN connector assembly, according to claim 1, wherein the clamping plate is fabricated from a plastic.

9. The DIN connector assembly, according to claim 1, wherein the gasket is fabricated from an elastomer.

10. The DIN connector assembly, according to claim 1, wherein the inner portion of the gasket, the lower portion of the gasket and the outer portion of the gasket form a ring-shaped recess that receives the pressure ring.

11. The DIN connector assembly, according to claim 1, wherein the pressure ring extends around a perimeter of the opening in the substrate.

12. The DIN connector assembly, according to claim 1, wherein the inner portion of the gasket has an equilibrium thickness and is compressed no more than 30% of its equilibrium thickness.

13. The DIN connector assembly, according to claim 12, wherein the lower portion of the gasket has an equilibrium thickness and is compressed more than 30% of its equilibrium thickness.

14. The DIN connector assembly, according to claim 1, wherein a length of the inner surface of the pressure ring, a length of the lower surface of the pressure ring, and a length of the outer surface of the pressure ring are all smaller than lengths of the cylindrical outer surface of the DIN connector, the substantially planar surface of the substrate, the inner surface of the inner portion of the gasket, and the outer surface of the inner portion of the gasket.

15. A cylindrical assembly, comprising:

a substrate having a substantially planar surface and an opening extending into said substrate;

a cylindrical body extending into said opening into said substrate, said cylindrical body having a cylindrical outer surface;

a gasket having an inner portion, a lower portion, and an outer portion, the inner portion of the gasket having an inner surface, an outer surface, and a bottom surface, the inner surface of the inner portion of the gasket mating with the outer surface of the cylindrical body, the bottom surface of the inner portion of the gasket being substantially parallel to said substantially planar surface of said substrate, the lower portion of the gasket having an upper surface, the outer portion of said gasket having an inner surface and an upper surface;

a clamping plate having a lower surface and an outer surface, the lower surface of the clamping plate being substantially planar and mating with said substantially planar surface of said substrate and said upper surface of said outer portion of said gasket, the outer surface of said clamping plate mating with said outer surface of said inner portion of said gasket; and a pressure ring having an inner surface, an outer surface, and a lower surface, the inner and outer surfaces of the pressure ring extending away from said clamping plate into said opening in said substrate, the inner surface of the pressure ring mating with the outer surface of the inner portion of the gasket, the outer surface of the pressure ring mating with the inner surface of the outer portion of the gasket, and the lower surface of the pressure ring mating with the upper surface of the lower portion of the gasket.

16. The cylindrical body assembly, according to claim 15, further comprising a flat rectangular part disposed below said bottom surface of said inner portion of said gasket, the flat rectangular part having a thickness larger than a diameter of the cylindrical body.

* * * * *